United States Patent [19]

Skinner

[11] 4,393,844

[45] Jul. 19, 1983

[54] LIQUID FUEL PUMPING APPARATUS

[75] Inventor: Robert T. J. Skinner, High Wycombe, England

[73] Assignee: Lucas Industries Limited, Birmingham, England

[21] Appl. No.: 439,815

[22] Filed: Nov. 8, 1982

Related U.S. Application Data

[63] Continuation of Ser. No. 153,780, May 27, 1980, abandoned.

[30] Foreign Application Priority Data

Jul. 6, 1979 [GB] United Kingdom ..... 7923685

[51] Int. Cl.[3] ..... F04B 23/10; F04B 19/02

[52] U.S. Cl. ..... 123/450; 123/516; 123/198 DB; 417/462; 417/206

[58] Field of Search ..... 123/516, 506, 467, 461, 123/450, 198 D, 198 DB; 417/199 A, 283, 434, 435, 253, 206, 462

[56] References Cited

U.S. PATENT DOCUMENTS

| | | | |
|---|---|---|---|
| 814,883 | 3/1906 | Starr | 417/435 |
| 3,181,468 | 5/1965 | Roosa | 417/206 |
| 3,283,668 | 11/1966 | Louchio | 91/498 |
| 3,936,244 | 2/1976 | Drori | 417/435 |
| 3,970,414 | 7/1976 | Mowbray | 417/462 |
| 4,153,027 | 5/1979 | Drori | 417/462 |
| 4,309,151 | 1/1982 | Craven | 417/206 |
| 4,325,676 | 4/1982 | Fenne | 123/450 |

*Primary Examiner*—Charles J. Myhre
*Assistant Examiner*—Carl Stuart Miller

[57] ABSTRACT

A liquid fuel injection pumping apparatus for supplying fuel to an engine includes an injection pump to which fuel is supplied through a feed passage in a distributor member from a low pressure pump. Fuel is delivered by the injection pump through a separate delivery passage which can register with an outlet. In order to enable air to be purged from the passages and injection pump, the delivery passage during the time fuel is being supplied to the injection pump is arranged to register with a further port which communicates in the example with a fuel supply tank. A restrictor is provided to control fuel flow through the further port.

1 Claim, 3 Drawing Figures

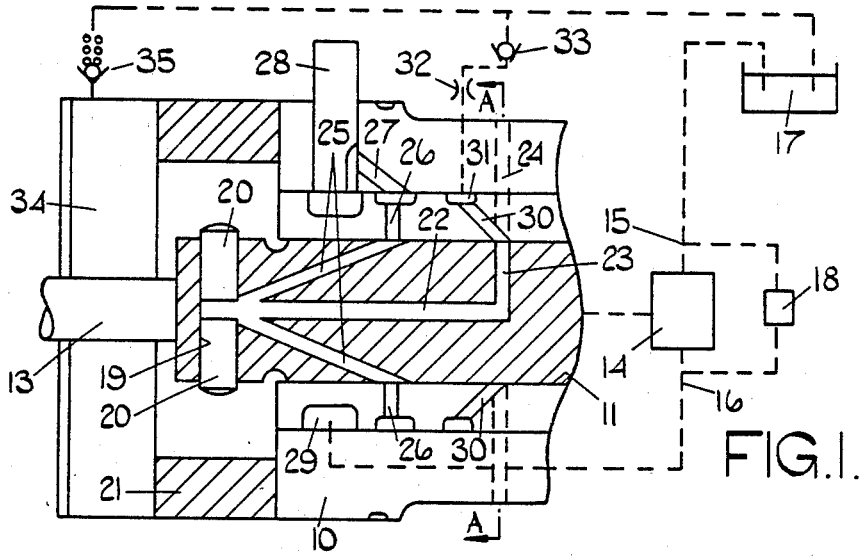
FIG.1.
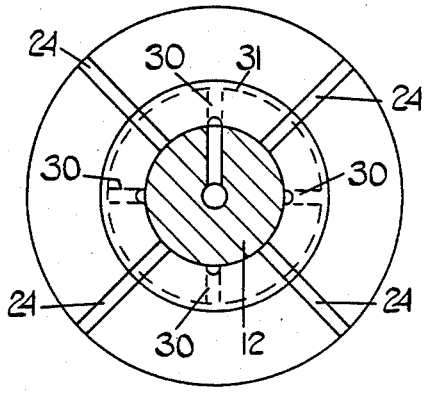
FIG.2.
FIG.3.
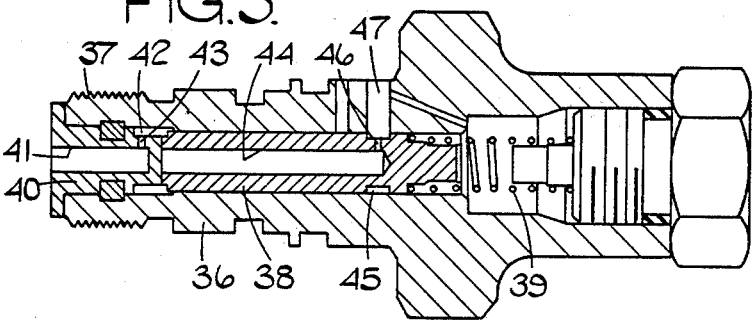

LIQUID FUEL PUMPING APPARATUS

This is a continuation of application Ser. No. 153,780, filed May 27, 1980 now abandoned.

This invention relates to liquid fuel injection pumping apparatus for supplying fuel to an internal combustion engine and of the kind comprising a body part, a rotary distributor member located in the body part and arranged in use, to be driven in timed relationship with the associated engine, a transverse bore formed in the distributor member, a pair of plungers in the bore, a delivery passage extending from said bore to a first axial position on the periphery of the distributor member, an outlet in the body part positioned to register with the delivery passage during inward movement of the plungers, cam means for imparting inward movement to the plungers as the distributor member rotates and while the delivery passage is in communication with the outlet, a supply passage in the distributor member, said supply passage communicating with the bore and extending to a second axial position on the periphery of the distributor member which is axially spaced from said first position, a supply port formed in the body part for communication with said supply passage during at least part of the time between successive inward movements of the plungers, a source of fuel under pressure and an adjustable throttle through which fuel from the source can flow to the supply port.

Apparatus of the type described is known in the art and the provision of the separate passages facilitates the venting of air from the passages in the apparatus when air has been allowed to enter the apparatus for example when the fuel tank from which fuel is supplied to the apparatus, has been allowed to run dry. In such a case the air can pass along the supply passage to the bore and from the bore the air will pass along the delivery passage. The venting of the apparatus will be greatly facilitated if the pipe line which is connected to the outlet is disconnected at the outlet or at the associated nozzle. If this is done then while operating the apparatus during the purging process, the trapped air will not be pressurized to any substantial extent and the air will be quickly expelled from the passages. The action of disconnecting the pipe line is time consuming and inevitably fuel spillage occurs onto the exterior of the apparatus or the engine. It is known to provide a manually operable vent to the exterior of the apparatus and through which the air can be vented during the inward movement of the plungers. Again however there is a risk of spillage of fuel.

The object of the present invention is to provide an apparatus of the kind specified in a simple and convenient form.

According to the invention in an apparatus of the kind specified a further port is formed in the body part and is positioned at said second axial position for registration with said delivery passage during at least part of the time said supply port is in communication with said supply passage whereby a flow of fuel together with any air, can take place along the supply passage, along the delivery passage and through said further port.

One example of an apparatus in accordance with the invention will now be described with reference to the accompanying drawings in which:

FIG. 1 is a diagrammatic sectional side elevation of the apparatus;

FIG. 2 is a cross-sectional side elevation taken on the line AA of FIG. 1; and

FIG. 3 is a sectional side elevation of an alternative form of valve.

Referring to FIGS. 1 and 2 of the drawings the apparatus comprises a body part 10 in which is formed a bore 11 which houses a rotary cylindrical distributor member 12. At one end the distributor member is connected to a drive shaft 13 which in use is connected to the associated engine whereby the distributor member is driven in timed relationship with the engine. Conveniently the other end of the distributor member is connected to the rotary part of a feed pump 14 having an inlet 15 and an outlet 16. The inlet 15 is connected by way of a pipe line to a fuel tank 17 and a control valve 18 is provided to control the output pressure of the feed pump.

Formed in the distributor member is a transversely extending bore 19 in which is located a pair of pumping plungers 20. The plungers through the intermediary of rollers (not shown), are moved inwardly by cam lobes which are formed on the internal peripheral surface of an annular cam ring 21 located within the body part. The bore 19 communicates with a longitudinally extending delivery passage 22 which has a branch portion 23 extending to the periphery of the distributor member. The portion 23 of the delivery passage can register in turn with a plurality of outlets 24 formed in the body part and which in use, are connected to the injection nozzles respectively of the associated engine.

Also formed in the distributor member is a pair of supply passages 25. At one end each supply passage is in communication with the bore 19 and at its other end it terminates in a port. The two ports defined by the supply passages lie in a common plane which is axially spaced from the plane containing the outlets 24. The two ports are also diametrically disposed and are positioned to register in turn with supply ports 26 formed within the body part of the apparatus. The supply ports at their outer ends, communicate with a circumferential groove and this in turn communicates with a single port 27 formed in the body part and which extends into a bore occupied by an angularly movable throttle member 28. The throttle member 28 is provided with a longitudinal groove which opens onto a circumferential groove 29 formed in the body part and communicating with the outlet 16 of the feed pump.

The operation of the apparatus thus described is as follows. Considering the parts to be in the position shown in the drawings, fuel is being fed by way of the throttle to the supply ports 26 and from the ports 26 to the bore 19 by way of the supply passages 25. The amount of fuel which flows to the bore 19 and hence the extent of the outward movement of the plungers 20 is dependent upon the setting of the throttle member. As the distributor member further rotates, the supply passages will move out of register with the supply ports and the portion of the delivery passage 23 will move in to register with one of the outlets 24. While the passage 23 is in communication with an outlet the plungers 20 are moved inwardly by the cam lobes which are formed on the internal periphery of the cam ring 20 and the effect of this is that fuel will be displaced from the bore 19 to the respective injection nozzle of the engine. Further rotation of the distributor member moves the passage 23 out of register with the port 24 and the supply passages 25 move into register with supply ports 26 which are disposed at right angles to those shown in the drawing. The supply of fuel to the bore 19 now takes place and the cycle of operations is repeated. In the example shown four outlets 24 are provided and therefore there will be two pairs of diametrically disposed cam lobes the pairs being disposed at right angles to each other.

As explained if the fuel tank 17 is allowed to run dry then air will eventually flow from the outlet 16 of the feed pump 14 and will find its way into the passages in the distributor member. In such a case the supply of fuel to the engine will cease and when the fuel tank is refilled with fuel it is necessary to purge the various passages of air before the engine can operate correctly.

If one or all of the connections between the outlets and the associated nozzles is/are disconnected, then as the distributor member is rotated, air will be pumped by the plungers along the delivery passage 22 and through the outlets in turn. As fuel starts to flow into the apparatus a mixture of air and fuel will follow this path the fuel however will be spilled to the exterior of the apparatus. In order to avoid the need to disconnect an outlet or the outlets, there is formed in the body part a further set of ports 30 which at their outer ends communicate with a circumferential groove 31 and at their inner ends break out onto the periphery of the distributor member in the plane occupied by the outlets 24 the further ports are however alternatively spaced relative to the outlets 24. The groove 31 communicates by way of a restricted orifice 32 and a non-return valve 33 with a drain which leads back to the fuel tank. It will be seen that the portion 23 of the delivery passage can communicate alternatively with the outlets 24 and the further ports 30. The communication of the portion 23 of the delivery passage with a port 30 takes place while the supply passages 25 are in register with the supply ports 26. This means that fuel besides being supplied to the bore 19 also flows along the delivery passage and through one of the further ports 30 to the fuel tank by way of the orifice 32 and the non-return valve 33. Any air entrained with the fuel will therefore have the chance of escaping and the fuel which is in effect lost will be contained within the fuel system. Moreover, there is no need for the operator to disconnect any part of the apparatus to achieve purging of the air.

It is important that the size of the orifice 32 should be so chosen that the flow of fuel therethrough does not hamper the filling of the bore 19 when the engine is running slowly or is being started.

The purpose of the valve 33 is to prevent the possibility of fuel being drawn directly from the tank into the pumping apparatus. Normally this will not occur because the space which is indicated at 34 will be filled with fuel at a pressure which is determined by a relief valve 35. Fuel enters the space 34 due to leakage of fuel along the various working clearances. Fuel may however be deliberately supplied to the space 34 by way of a restricted flow from the outlet of the feed pump. Such restricted flow can be utilized to minimize the risk of air entering the passages within the distributor member.

There are other advantages which accrue from the construction as described. The flow of fuel through a further port 30 occurs each time the bore is filled and this flow of fuel takes place by way of the throttle 28. This means that the movement of the throttle is less critical at low deliveries of fuel and this can assist the governor to which the throttle is connected to maintain a consistent idling speed of the engine.

A further advantage is that when the throttle valve is closed as for example when the maximum governed speed of the engine has been attained, the plungers 20 can close inwardly their maximum amount owing to the pressure of the fuel in the space 24. They therefore are never actuated by the cam lobe so that the supply of fuel to the engine is completely cut off. In some forms of apparatus even with the throttle valve completely closed the plungers do pump a very small quantity of fuel to the engine and this fuel leads to objectionable exhaust smoke since it is not burned properly in the engine. Moreover, it is possible for the fuel in the various passages to become excessively hot and this can lead to seizure of the distributor member. Both these problems are avoided with this construction because the pressure in the space 34 moves the plungers inwardly their maximum extent so that no pumping action can take place.

The valve 33 is a simple non-return valve which may be lightly spring loaded to the closed position providing it can open when the engine is cranked for starting purposes. The valve 33 and the restrictor 32 act to make the setting of the throttle less critical at low fuel flow rates. However, when the flow of fuel to the engine is at a high rate the flow of fuel through the valve 33 can be a nuisance because it represents a loss of fuel so far as the low pressure pump 14 is concerned. This means that it may be necessary to increase the capacity of the low pressure pump for some application.

The valve which is shown in FIG. 3 overcomes this problem since it is responsive to the pressure of fuel flowing through the ports 30. The valve comprises a sleeve 36 having a threaded portion 37 engageable within a threaded bore in the pump body. The bore in the sleeve is occupied by a valve member 38 which is spring loaded by a coiled compression spring 39 towards the end of the bore remote from the outlet. In the end of the bore which is slightly enlarged, is located a flanged plug 40 which has a central blind bore 41 connected in use to the circumferential groove 31. The inner end of the plug is of reduced diameter to define an annular space 42 which is connected with the bore 41 by a small diameter drilling 43. The plug constitutes a stop for the valve member.

The valve member is also provided with a blind bore 44 which extends from the end of the valve member adjacent the plug 40 and communicates with a circumferential groove 45 on the periphery of the valve member by way of a small diameter drilling 46. In the rest position of the valve member as shown, the groove 45 registers with a port 47 in the sleeve 36 and fuel flowing through this port is returned to the fuel tank.

In operation, when the engine is being cranked for the the purpose of purging air from the passages of the pump, the intermittent pressure of air and fuel applied to the valve member will be sufficient to lift the valve member a small amount away from the plug 40 thereby to allow air and fuel to flow to the fuel tank by way of the drillings 41, 43, 44 and 46. The drilling 43 takes the place of the restrictor 32. This process will continue and gradually the air will be displaced. The valve member will also be lifted from the plug to allow flow of fuel and at low throttle settings but as the average pressure applied to the valve member increases the flow of fuel will increase and the pressure drop across the drilling 46 will increase to the point at which the valve member will move against the action of the spring 39 to close off the port 47 thereby preventing further flow of fuel.

With the port 47 closed the valve member is subject to the full pressure of fuel in the circumferential groove 31 and will only return to the plug when the pressure of the fuel falls by a sufficient amount.

I claim:

1. A liquid fuel injection pumping apparatus for supplying fuel to an internal combustion engine and comprising a body part which defines a cavity, a rotary distributor member located in the body part and arranged in use, to be driven in timed relationship with the associated engine, a transverse bore formed in the distributor member, a pair of plungers in the bore, the outer end of said plungers being exposed within said cavity, a delivery passage extending from said bore to a first axial position on the periphery of the distributor member, an outlet in the body part positioned to register with the delivery passage during inward movement of the plungers as the distributor member rotates and while the delivery passage is in communication with the outlet, a supply passage in the distributor member, said supply passage communicating with the bore and extending to a second axial position on the periphery of the distributor member which is axially spaced from said first position, a supply port formed in the body part for communication with said supply passage during at least part of the time between successive inward movements of the plungers, a source of fuel under pressure, an adjustable throttle through which fuel from the source can flow to the supply port, a further port formed in the body part, said further port being positioned at said first axial position for registration with said delivery passage during at least part of the time said supply port is in communication with said supply passage whereby a flow of fuel together with any air, can take place along the supply passage, along the delivery passage and through said further port, and valve means for pressurizing fuel leaking into said cavity whereby when said throttle is closed to prevent fuel flow to said bore, said plungers will be moved inwardly their maximum extent to prevent actuation thereof by said cam means.

* * * * *